US008523403B2

(12) United States Patent
Pujol

(10) Patent No.: US 8,523,403 B2
(45) Date of Patent: Sep. 3, 2013

(54) LED WHITE LIGHT LUMINAIRE WITH IMAGING CAPABILITY

(75) Inventor: Roger Pujol, Peekskill, NY (US)

(73) Assignee: Altman Lighting Co., Inc., Yonkers, NY (US)

( * ) Notice: Subject to any disclaimer, the term of this patent is extended or adjusted under 35 U.S.C. 154(b) by 810 days.

(21) Appl. No.: 12/652,530

(22) Filed: Jan. 5, 2010

(65) Prior Publication Data

US 2011/0164416 A1 Jul. 7, 2011

(51) Int. Cl.
*F21V 7/00* (2006.01)

(52) U.S. Cl.
USPC . 362/307; 362/249.02; 362/285; 362/296.01; 362/311.02; 362/318; 353/85; 353/98

(58) Field of Classification Search
USPC ..... 353/85, 98; 362/235, 285, 296.01, 362/307, 311.02, 318, 249.02
See application file for complete search history.

(56) References Cited

U.S. PATENT DOCUMENTS

| | | | | |
|---|---|---|---|---|
| 6,213,627 | B1 * | 4/2001 | Abersfelder et al. | 362/487 |
| 7,806,558 | B2 * | 10/2010 | Williamson | 362/249.02 |
| 7,967,445 | B2 * | 6/2011 | Hamano et al. | 353/31 |
| 2009/0079947 | A1 * | 3/2009 | Sun et al. | 353/85 |

* cited by examiner

*Primary Examiner* — Stephan F Husar
(74) *Attorney, Agent, or Firm* — Lackenbach Siegel, LLP; Myron Greenspan

(57) ABSTRACT

A reflector spotlight luminaire includes a housing defining an optical axis. The light source is provided that includes one or more white light emitting LEDs, the lights being arranged to direct a beam of white light along the axis of the housing, such as being reflected from an ellipsoidal reflector. An image engine in the form of an LCD panel intercepts the beam of white light traveling along the axis to modify and enhance the beam of white light with image data, such as color, shape, animation, etc. Conventional projection optics accumulates the image emitted by the image engine, projects the optically enhanced light beam through the housing onto a projection surface.

20 Claims, 5 Drawing Sheets

LED WHITE LIGHT LUMINAIRE WITH IMAGING CAPABILITY

BACKGROUND OF THE INVENTION

1. Field of the Invention

The present invention generally relates to theatrical and architectural luminaires and, more specifically, to a white LED luminaire with imaging capability including changing colors, shapes and projecting static and dynamic images.

2. Description of the Prior Art

In the entertainment lighting industry, numerous luminaires are known for creating various lighting effects with both static and movable and controllable spot lights.

For example such luminaires such as ellipsoidal reflector spotlights are made available by Altman Lighting, Inc. of Yonkers, N.Y. as fixed focus luminaires under Model Nos. S6C-5, S6C-10, S6C-20, S6C-30, S6C-40 and S6C-50. Similar luminaires are also available as zoom ellipsoidal spotlights, made available by Altman Lighting, Inc. under its trademark "Shakespeare" under Model Nos. S6C-1535Z and S6C-3055Z. The aforementioned luminaires are typically configured with 120 volt lamps that typically vary from 575-1000 watts. The luminaires include an ellipsoidal reflector that projects light through a condenser lens, the resulting beam passing through a shutter assembly and a gobo iris plate slot, these being traditionally used to mechanically dim or blackout the light beam projected downstream and to impart to the beam a desired design within a spotlight by projecting the illuminated representation of a design. The beam is then directed through an objective projection optical lens system for focusing the beam and/or projected design. These fixtures also typically include a gel frame holder for securing color gel sheets or color filters to modify the color of the projected beam.

While ellipsoidal projectors are staples in the entertainment and theatrical lighting industries, they generate large quantities of heat. Also, lamps typically used are rated between 5,000-12,000 hours before they have to be replaced. Normally, the higher the voltages of the bulbs, the shorter the lifespan. Therefore, these lamps need to be changed periodically and this can be problematic as these luminaires are frequently secured on tresses or beams high above the ground in theaters, stadiums and the like. Also, while such luminaires have provided many of the desired functions, they have also lacked some flexibility in use since the shutter assemblies, the gobo rotators and the insertion or exchange of gel plates must frequently be adjusted manually. Because these luminaires are frequently inaccessible, it has sometimes been necessary to use a number of luminaires, each set for different beam property, such as color pattern, etc. and the appropriate luminaires energized to obtain the desired effect(s). Therefore, once these luminaires are set up for a given type of beam, it is usually fixed in that condition to generate only that type of beam.

In order to reduce the heat generated by conventional luminaires and to increase the lifespan of the light sources, more and more use has been made of light emitting diodes (LEDs). While LEDs consume much less energy and have longer lifespans, LEDs are only now beginning to generate the light intensities that make them useful in commercial luminaires and light or image projectors used for stage lighting and other such applications. Many of the known LED luminaires employ clusters of red, blue and green (RCB) primary color LEDs. By controlling each of the LEDs the luminaires can project different color beams. In theory, energizing all three primary colors red, green, blue LEDs create a white light beam. However, in practice, such luminaires have not been totally acceptable. One of the primary functions or requirements of luminaires is to project a beam of pure or white light. However, because differently colored LEDs emit different hue, saturation and brightness or intensify of light for given currents driven through the LEDs, it is difficult to match the color outputs in the proper proportions to provide a purely white beam. The intensity of a spectral color may alter its perception considerably; for example, a lower intensity orange-yellow may appear to be a brown, while a low intensity yellow-green may appear as olive-green. In fact, in practice, no mixture of colors can produce a fully pure color perceived as completely identical to a spectral color. Accordingly, if the "primary" colors are not pure themselves, any combinations of the colors reproduced are never perfectly saturated colors, and so spectral colors cannot be matched exactly. Also, different color LEDs generate colors that are slightly off from each other, so that two green LEDs, for example, do not always emit the identical colors and, when mixed with other "primary" colors will not generate pure white light. Thus, while LED luminaires have been proposed and they do provide cooler light with the ability to modify color, they have been less than satisfactory in projecting a powerful white light beam.

Also known are LCDs projectors that utilize a light source for projecting a light beam onto an LCD panel. By controlling the signals to the panel image information can be imparted to the beam that is generated by the panel and a modified beam can be projected using conventional optical system. Thus, for example, in U.S. Pat. No. 6,409,350 an LCD projector is disclosed that includes an image data source producing image data. A light source provides light projected onto an LCD panel which modifies the light emitted from the light source in accordance with the image data. A projector lens projects the image from the LCD panel to an enlarged screen. The LCD acts as an image forming member. The light source is disclosed as being a luminescent lamp, such a mercury lamp. The image data inputted into the LCD screen is processed by a color correcting circuit to control or modify the three primary RGB colors output BY the LCD panel. This is another approach for obtaining a white light beam. However, the use of such color correction circuitry by use of look up tables and the like increases the cost of the unit and provides a desired output only when the correction circuitry functions properly.

In U.S. Pat. No. 6,765,544 an image projection apparatus is disclosed that includes a viewing surface dependent image correction. The apparatus includes a deflector to deflect a light beam from a video projector in a plurality of directions. An image processing circuit is used to process image information to modify the image information and provide a desired light output. The apparatus generates a beam by means of a lamp and an ellipsoidal reflector, the lamp being situated at the focal point of the reflector. Although the patent does not specifically discuss the nature of the lamp used, it is illustrated as being an incandescent or gas discharge type lamp. An image generating engine is disclosed that alters the shape of the light beam to generate an image in a light beam using a DLP device of the type made available from Texas Instruments, Inc. and typically comprises a plurality of digitally controllable micro mirrors.

U.S. Pat. No. 6,979,960 discloses a circuit for driving a light source. The patent discloses a light source capable of lengthening the lifespan of the light source by using a circuit that controls the device to drive the light source, which is composed of a discharge tube. By switching the light source to a plurality of lighting modes and controlling the power applied to the light source, the light source cannot break within its safety limits. The patent discloses the use of a high pressure mercury lamp as the light source. However, it is also suggested that the metal lamp or halogen lamp can also be used.

An image projector is disclosed in U.S. Pat. No. 7,111,944. The patent discusses a use of a high intensity discharge lamp as a light source for displaying an image brightly. The projector uses a discharge lamp and a micro mirror device (DLP). The micro mirror device serves as an image generator by controlling each micro mirror corresponding to image data to reflection direction of a light beam admitted from discharge lamp.

U.S. Pat. No. 7,232,236 discloses a floor marking apparatus for creating a pattern on a floor including a graphic pattern and a color pattern.

Thus, prior art ellipsoidal reflector spot lights that have used of LEDs and those that have also incorporated image engines in the form of LCD panels have had shortcomings and have not been suitable for many applications. Most gas discharged lamps typically used in ellipsoidal luminaires or spotlights employ noble gases such as argon krypton xenon, or mixtures of these gases. Most of these lamps are also filled with additional substances such as mercury, sodium and/or metal halides. However, each gas, depending on its wavelengths, translates into different color spectrums of the lamp. The International Commission on Illumination (CIE) has, therefore, introduced a color rendering index. Some gas discharged lamps have relatively low CRI, which means colors they illuminate are substantially different than they appear under sunlight or other high-illumination. Helium gas lamps typically emit a white to orange and, on some conditions, may be grey, blue or green-blue. Neon gas generally emits a red-orange color. Argon emits a violet to pale lavender blue while krypton emits off-white to green. Under high peak current krypton emits a bright blue-white. Xenon emits a grey or blue-grey dim light and at high peak currents a very bright green-blue color light. Nitrogen has color properties similar to argon but somewhat more pink and at high peak currents a bright blue-white. Oxygen emits a violet to lavender, while hydrogen emits a lavender at low currents while emitting a pink to magenta over 10,000,000 mA. Mercury vapor lamps frequently emit a light blue, intense ultraviolet light while sodium vapor (at lower pressure) emit a bright orange-yellow color light. As evident, therefore, not only do RGB clusters of LEDs fail to reliably generate pure white light but also most gas discharge lamps fail to provide such white light.

SUMMARY OF THE INVENTION

Accordingly, it is an object of the invention to provide an ellipsoidal luminaire or reflector spotlight that avoids the disadvantages or drawbacks of prior art luminaires.

It is another object of the invention to provide a reflector spotlight that utilizes LEDs to produce white light or a white light beam without relying or combining the light outputs of RGB clusters of LEDs.

It still another object of the invention to provide a reflector spotlight that provides a true or natural white light by using only white light emitting LEDs.

It is yet another object of the invention to provide a reflector spotlight as in the previous objects to provide a highly efficient reflector spotlight that generates significant lower heat than conventional spotlights.

It is a further object of the invention to provide a reflector spotlight of a type under discussion that maintains the quality of the white light beam substantially constant even over extended periods of time.

It is still a further object of the present invention to provide a reflector spotlight using white light LEDs in combination with an LCD panel image engine for modifying white light generated by the LEDs to a beam of light that can vary varying or desired colors by applying appropriate signals to the image agent.

It is yet a further object of the invention to provide a reflector spotlight as in the previous object in which the image engine is in form of an LCD panel.

It is an additional object of the invention to provide a reflector spotlight of the type under discussion that can provide, starting with the white light, static or dynamic images in the light beam by passing a beam of light through an LCD panel and subsequently to an optical projection system of lenses.

In order to achieve the above objects, as well as others which will become evident from the disclosure, a reflector spotlight luminaire in accordance with the present invention comprises a housing defining an optical axis. A light source is provided at one axial end of said housing and includes at least one white light-emitting LED, so the light source being arranged to direct the beam of white light along the axis of said housing and in the direction of axially opposite end. An image engine is arranged along said axis between said light source and said opposite end for imparting image data to the projected optical image data to the projected light beam. Projection optics is provide for accumulating the image or light data emitted by said image engine and projection an optically enhanced light beam through said housing onto a projection surface.

In accordance with the presently preferred embodiments, the reflector spotlight luminaire is in the form of an ellipsoidal reflector spotlight that utilizes a cluster of white light emitting LEDs arranged at the focal point of the elliptical reflector. The image engine is in the form of an LCD panel arranged proximate to a second focal point of the elliptical reflector. A condensing lens or other optical elements can be used to accumulate the light beam directed at the LCD panel, the size of the LCD panel being a function of its position in the relation to the second focal point to ensure that accumulated light emitted by the light source is applied to the LCD panel.

BRIEF DESCRIPTION OF THE DRAWINGS

Those skilled in the art will appreciate the improvements and advantages that derive from the present invention upon reading the following detailed description, claims, and drawings in which:

DESCRIPTION OF PREFERRED EMBODIMENTS

Figure 1:
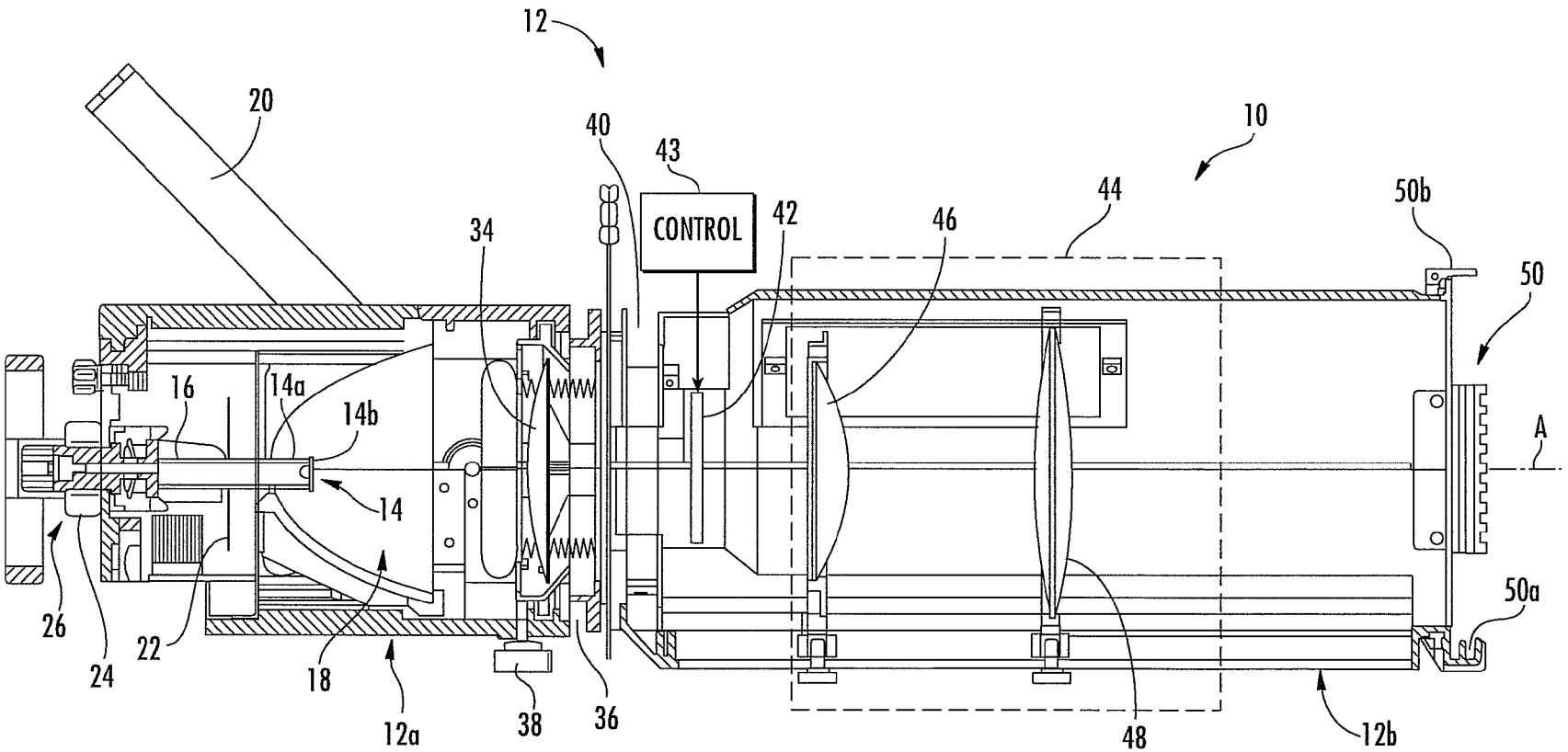
FIG. 1 is a cross sectional view of a ellipsoidal reflector spotlight in accordance with the present invention, illustrating the position of a white light emitting LED and the position of an LCD panel which forms an image engine for modifying the white light beam emitted by the LED.

Referring to the Figures in which the identical or similar parts are designated by the same numerals throughout, and first referring to FIG. 1, an ellipsoidal reflector or spotlight luminaire in accordance with the present invention is generally designated by the numeral reference 10.

The luminaire or spotlight 10 includes a generally cylindrical housing 12 defining an optical axis A. The housing 12 includes a rear illumination portion 12*a* that includes a light source 14 and a front projection portion 12*b*, the light source 14 being at one axial end of the housing 12 and includes means for generating white light directly without combining RGB components from the individual or different color light emitting LEDs. Thus, the LED 14*a* is preferably a white light emitting LED. However, any other light source, preferably are that emits low heat and high intensity light, may be used with different degree of advantage.

The ellipsoidal reflector spotlight or luminaire 10 collects and directs the light from the light source through the housing 10 which is in form of a barrel that contains one or more lenses. Ellipsoidal reflector spotlights come in different shapes and sizes, each with their own set of characteristics. Frequently, they are used for stage lighting and are sometimes referred to profile spotlights because the beam can be shaped to the profile of an object. Ellipsoidal reflector spotlights are used for their strong, well defined light.

Figure 2:
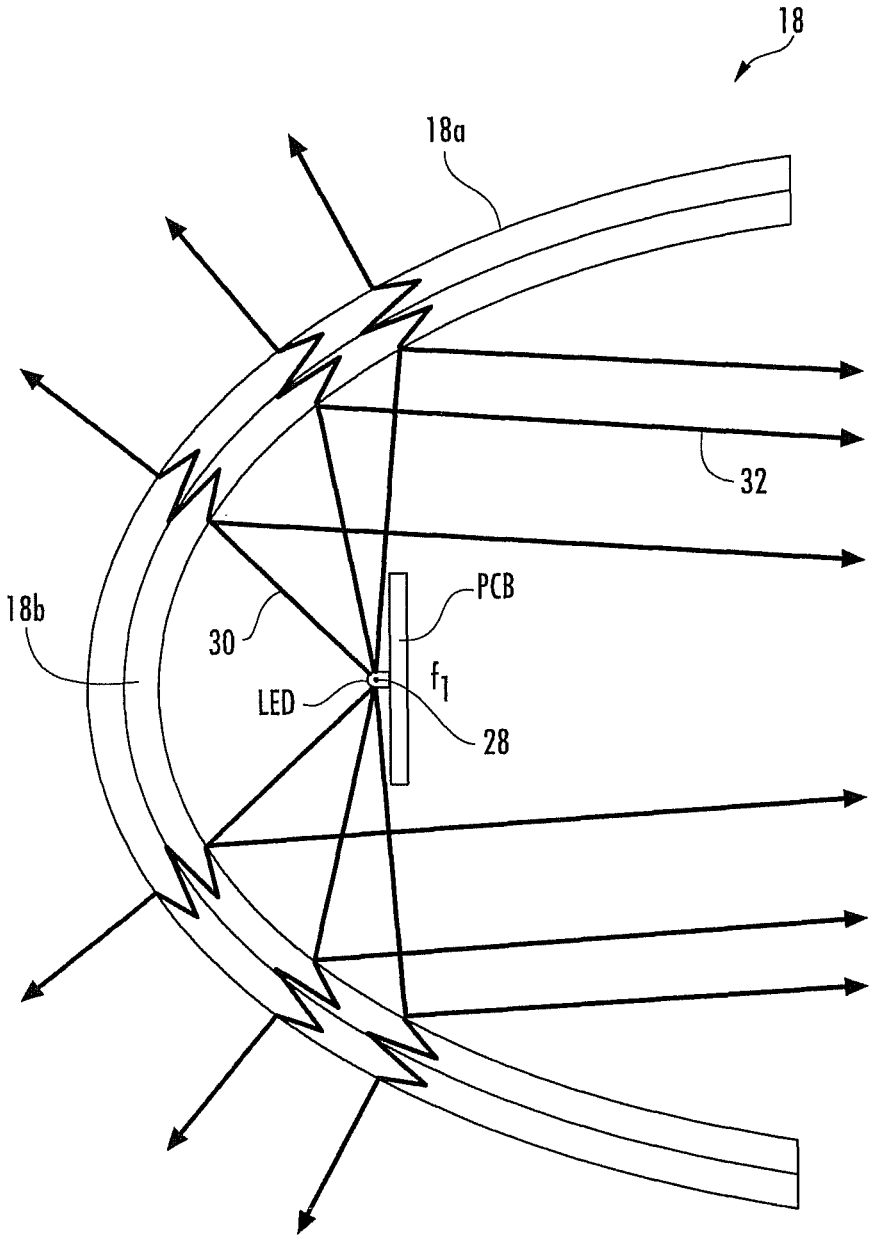
FIG. 2 is an enlarged schematic view of the ellipsoidal reflector shown in FIG. 1 and the position of the white light emitting LED or LEDs in relation to the spotlight reflector.

In the presently preferred embodiment, the LED 14*a* is mounted on a printed circuit board (PCB) 14*b*. The LED 14*a* is positioned substantially at a first focal point ($f_1$) of an ellipsoidal reflector 18. Referring also to FIG. 2, the ellipsoidal reflector 18 is typically a coated reflector made of a glass shell 18*a* coated on the inner surface thereof with a diochroic coating 18*b*, a diochroic coating is a metallic coating applied to glass or other material that allows certain wavelengths of light or other electromagnetic radiation to pass while reflecting all others. Such coating allow infrared and other heat generating wavelengths to be absorbed or retransmitted rearwardly instead of forwardly with the beam in the direction of projection.

A support bracket 20 allows the reflector spotlight 10 to be attached to or supported by a truss, beam or the like in a theater, concert hall, etc. A heat shield 22 may be provided to absorb and distribute some of the heat collected that passes through the dichroic coating. However, while such heat shields are typically used with incandescent and other light sources that generate much heat, such heat shield may be optional when used with LEDs as the light source.

A centering lock knob 24 is conventional and is provided also with lamp focus control 26 for adjusting the position of the LED in relation to the first focal point 28 ($f_1$). When the LED is shifted to one or the other side along the axis A, the incident rays of light 30 are reflected from the reflector 18 as rays 32 that can cause the reflected rays to converge more or less towards a second focal point at a point more or less remote from the reflector.

Ellipsoidal reflector spotlights also typically include a system of optical lenses for projecting the beam of light at a screen or other surface or other object to be illuminated. Typically, such spotlights include system of lenses that determine how wide the output of beam of light is and how sharp are the edges of the light beam. In FIG. 1, a condenser lens 34 is mounted within the rear illumination portion 12*a*, facing the reflector 18, for accumulating the light output from the reflector. The light is now projected through a spring pressured shutter assembly 36, the shutter assembly 36 serving as a mechanical dimmer or light blocking mechanism for shaping and narrowing the light beam. Some ellipsoidal reflector spotlights also have an iris to narrow the beam in the shape of a circle. The shutter assembly 36 is controlled by the shutter location lock knob 24 for fixing the condition of the shutter in any desired position.

A slot in the body of the housing 40 can be used for the insertion of metal gobos to change the pattern of light, the slot also having an ability to hold a glass gobo, dichroic or an effects unit.

Upstream of the gobo rotator slot 40 there is provided an image engine 42 in the form of an LCD panel. Generally, such a panel is rectangular or square and is fixed along the axis A. After the beam of white light is projected through the shutter assembly 36 it impinges on the LCD panel 42. The LCD panel may be any suitable active matrix color LCD panel, preferably with a digital analog interface. One example of a suitable LCD panel that may be used is available from Purdy Electronic Corporation of Sunnyvale, Calif. under its model No. ANDpSi020TD-LED. This is a 320×240 active matrix TFT LCD module. The module is capable of generating 16 million colors and has an active area of 40.672 mm (H)×30.48 mm (V) and has a dot pitch of 0.0635 (H)×0.127 (V) mm. The image engine may be controlled by a control circuit of the type generally disclosed in U.S. Pat. No. 6,409,350 and U.S. Pat. No. 6,765,544. The control circuit generates desired image data to modify the light beam transmitted through the LCD panel 42 to provide static color correction, static and/or dynamic images. DMX may be used to render the fixture more flexible and adaptable to various lighting industries.

Referring to FIG. 1, the light emitted through the LCD panel 42 is directed along the axis A towards the front projection portion 12*b*. The beam is passed through a system of optics 44. The system of optics itself is not critical and may be modified for any given or suitable application. In the illustrated embodiment, the system of optics 44 includes a Plano-convex lens 46 that serves as a condenser lens that directs the light beam towards an objective projection lens 48. The lenses used in the optical system 44 may be conventional and typical of many such spotlights or luminaires.

Figure 3:
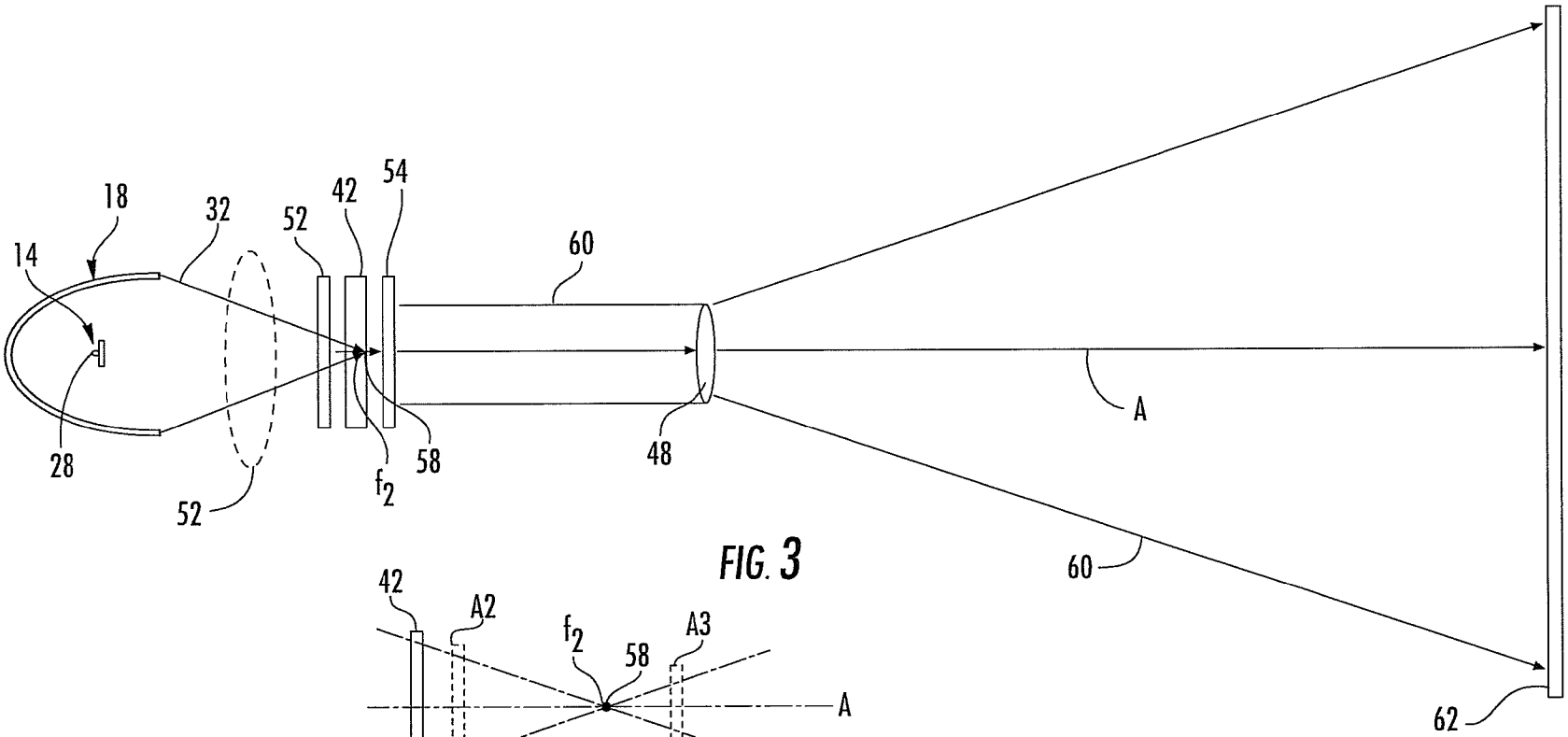
FIG. 3 is a diagrammatic representation of the optical transformations that take the place within the ellipsoidal reflector spotlight shown in FIG. 1 and illustrating a number of different optional optical light accumulating elements.

At the outlet end of the front projection portion 12*b* there is shown a gel frame holder 50 that includes gel frame slots 50*a* and a gel frame retainer 50*b*. Typically, such color gel frame holders or color frames are used to hold color media or other types of filters that can assume various shapes and sizes. Slots and clips located at the front of most luminaires are also used to retain other items as well, as such color wheels, barn doors, etc. However, such gel frame holders may be dispensed with, at least for holding color gel filters, since the white light generator is capable of being modified by the image generator or LCD panel 42 to modify the colors of the white beam, as desired. Referring to FIG. 3, a schematic representation of the system shown in FIG. 1 is illustrated in which the reflector 18 and white light source 28 causes a beam of white light to be emitted along the axis A. As indicated, the axial position of the light source 28 can be adjusted in relation to the first focal point 28 to cause the reflected rays 42 to converge at the second focal point 58 ($f_2$). In FIG. 3, an optional condensing lens 52 and upstream Freznel lens 52 may be used to condense or collect the light beams at the second focal point 58 ($f_2$). While the LCD panel 42 is shown positioned at the second focal point 58, it is preferably positioned before or just after the second focal point where the beam of light is somewhat diverged. This prevents excessive heat from being generated on the LCD panel 42. Additionally, LCD panels have a given dot pitch. For any given sized LCD panel there is a minimum dot pitch. It is clear that placing an LCD panel at exactly the second focal point 58 ($f_2$) would result in a very few number of dots that would be intercepted by the light beam and, therefore, the amount of information that could be imparted to the light beam. In order to increase the number of dots, the LCD panel can be placed at a position where the light beam has a greater cross sectional area, either just before or just after the second focal point. For any given panel area of the beam the greater the DPI or dots per square inch the more costly the LCD panel. Therefore, there is a compromise that needs to be made between the cross sectional area impinging on the LCD panel and the maximum number of dots per square inch of the panel. The further the LCD panel is removed from the second focal point 58, the greater the cross sectional area of the light beam and the more dots that can be intercepted. However, generally the larger the panel the costlier it is. For a smaller panel to provide the same number of dot exposure will require a costlier and more expensive panel that has a greater dot density. The exact position of the LCD panel, therefore, will be a tradeoff in the resolution (DPI) of the panel and the size of the panel that can or should be used in any given application.

Referring again to FIG. 3, an optional lens 54 may be used on the down stream, such as a Fresnel lens, side of the LCD panel for collimating a light beam 60 towards the objective projection optical system or lens 48 which projects the beam 60' towards a screen 62 or other surface to be illuminated, in a conventional manner.

Figure 3A:
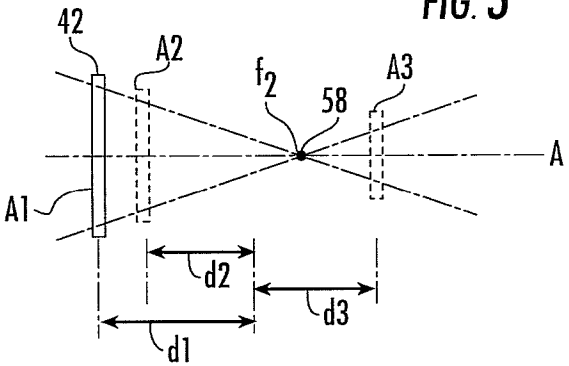
FIG. 3*a* is schematic diagram illustrating possible positions for the LCD panel shown in FIG. 3 in relation to the second focal point of the reflector.
Figure 3B:
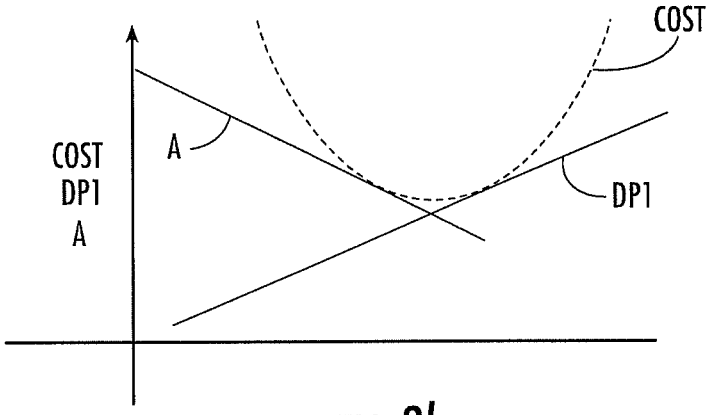
FIG. 3*b* is a graph illustrating the relative relationships between the surface areas of LCD panels, DPIs provided by the panels and relative costs of the LCD panels to provide a predetermined or given total number of dots for intercepting the white light beam generated by the light source.
Figure 4:
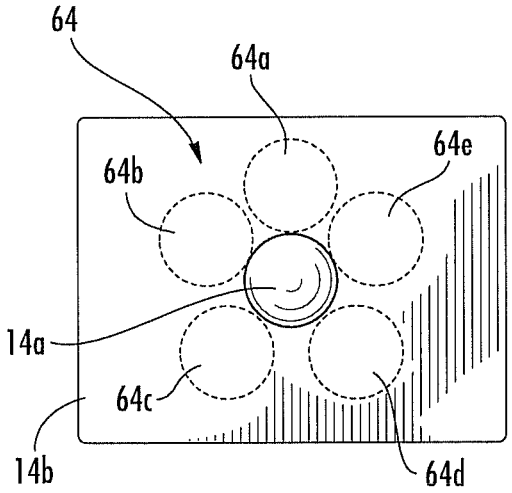
FIG. 4 is an enlarged front elevational view of the a printed circuit board of the type shown in FIGS. 1-3 including a cluster of white light emitting diodes mounted on the printed circuit board.

Referring to FIG. 3*a*, three LCD panels are shown at distances d1, d2 and d3 from the second focal point 58. The greatest distance d1 allows the panel to have a greater surface area A1 for a given or desired number of dots to be intercepted by the light beam, therefore, the LCD panel may be provided with a lower DPI. As the distance is reduced from the second focal point, the smaller the panel that can be used and, therefore, the greater the DPI that these panels must have to provide the same total number of dot exposure. At a distance d2 the panel has an area A2 upstream of the focal point 58, while a yet small area A3 at the smallest distance shown d3 requires greater DPI. As indicated in FIG. 3*a*, the LCD panels can be positioned either on the upstream or downstream side of the second focal point 58. Referring to FIG. 3*b*, general or proximate relationships are shown between the area A of the LCD panels, the number of DPI provided in the panel and the relationships of these to the cost of the panel. In order to provide a given or predetermined number of total dots within the panel for intercepting the incident light beam, this can be achieved either with a panel having a larger area with a lower number of DPI. However, as the panels become larger they become more costly and therefore the cost rises. Similarly, for smaller area panels the DPI must increase to provide a given number of dots. Again, the cost of the panel generally increases as the density of the dots become higher. Accordingly, there is an intermediate range where the size of the panel and number of dots per inch provide a reduced cost and a panel used for the spotlight can be selected on the basis of such relationships. However, there may be reasons to incur a higher cost and either operate with a large panel or a smaller panel with a larger DPI even though the cost of the panel might increase. This is the matter of design choice and can be determined for any given application.

Other arrangements of LEDs can also be used to provide a beam of white light to the image generator, such as those disclosed in U.S. Pat. Nos. 6,585,395; 6,908,214 and 7,152,996, all assigned to the assignee of the present patent application.

Figure 5:
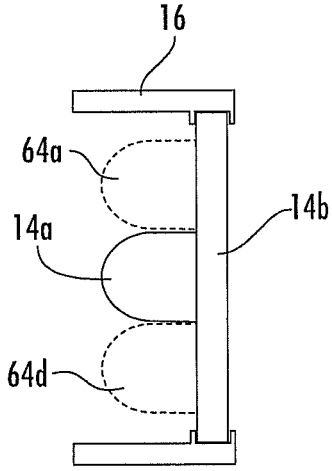
FIG. 5 is a side elevational view of the LED cluster shown in FIG. 4.
Figure 6:
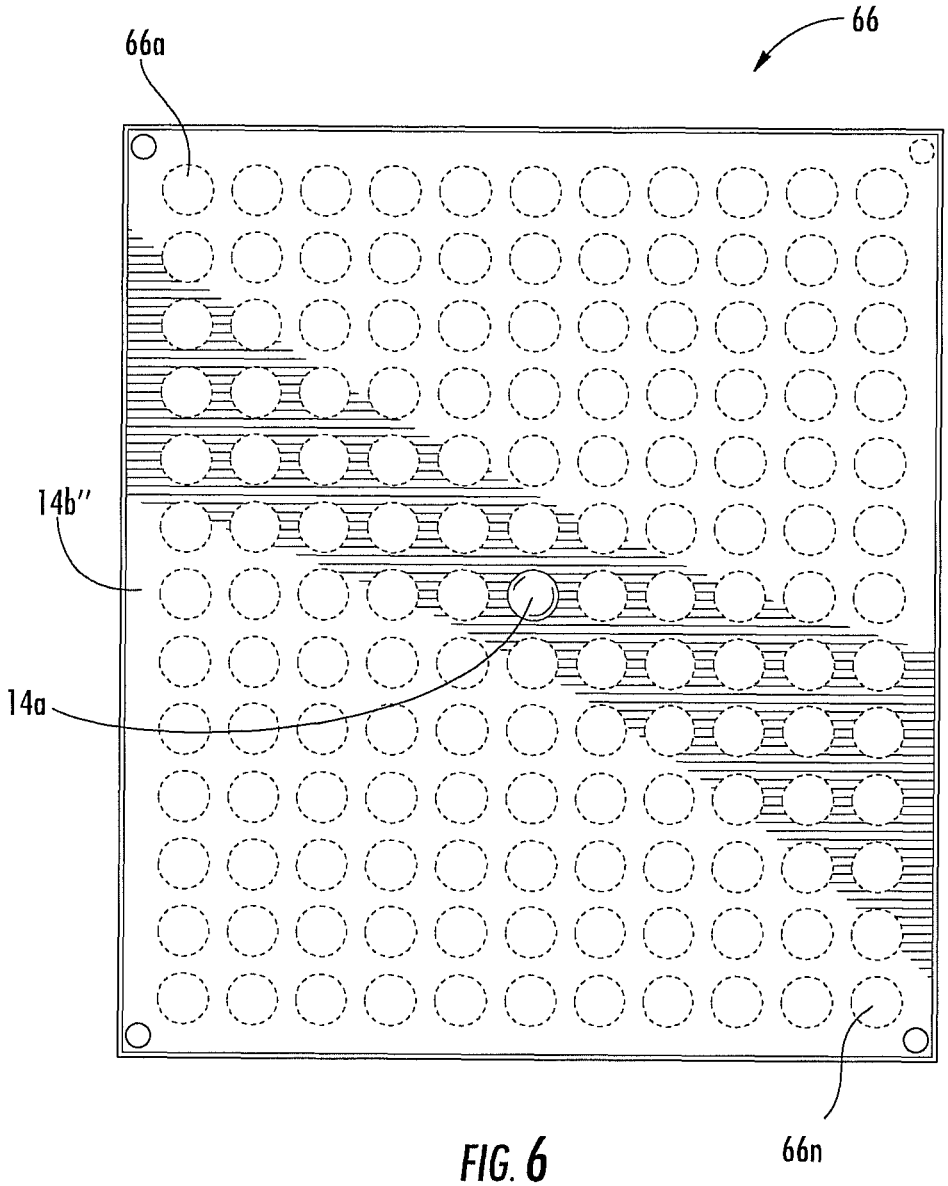
FIG. 6 is similar to FIG. 4 but illustrating a larger array of white light emitting diodes that can be used within a reflector spotlight of the type shown in FIG. 1.

The ellipsoidal spotlight in accordance with the present invention overcomes the problems with prior art LED ellipsoidal reflector spotlights and does not use clusters of RGB LEDs to generate white light. Because each of the LEDs referring to FIG. 5, a cluster of white light emitting LEDs 64 is shown consisting of LEDs 64A-64E surrounding the LED 14A on a large printed circuit board. In FIG. 6 a larger array 66 of LEDs is illustrated mounted on a printed circuit board 14B" consisting of white light emitting LEDs 66A-66M. Because all of the LEDs in the present invention emit white light only, the number of such LEDs used and their relative positions to each other are not critical. Clearly, the more LEDs that are provided, the higher the intensity of the white light beam generated.

With the reflector spotlight in accordance with the present invention reliable white light can be generated, this being an important if not primary function of the present invention. Also because only LEDs are utilized to generate white light, the cost of the spotlight can be reduced because many of the parts that had previously been made of metallic materials can not be made of plastic. Because the image data can be accurately controlled by the electrical control data applied to the image generator or LCD panel, all of the effects normally required to be performed by reflector spotlights can be achieved electronically, including changing the saturation, colors, gradient, shutter cuts, splits, gobo designs and fades. All these can be achieved without mechanical parts or moving components but simply by controlling, proximately or remotely, the electrical signals applied to the LCD panel by a control circuit 43.

It should be clear that although ellipsoidal reflector spotlights have been discussed, by way of example, other reflectors can be used, including parabolic, spherical, etc.

The luminaire or spotlights of the present invention, therefore, achieve all of the desired functions of such a unit. It has always been a major function of such spotlights to provide a clear and sharp beam of bright white light and the spotlight of the present invention can provide such a light beam. However, in addition to purely white light, the luminaire 10 also provides all of the other conventional features, all being controlled by electronic control instead of mechanical control while generating significantly less heat and allowing all of the desired effects, features or functions to be controlled remotely thereby avoiding the need to have multiple reflector spotlights to perform different functions because there are not readily accessible for modifications of mechanical components.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A reflector spotlight luminaire comprising a housing defining an optical axis; a light source at one axial end of said housing for emitting a beam of white light, said light source being arranged to direct said beam of white light along said axis of said housing and in the direction of an axially opposite end; an active matrix LCD panel arranged along said axis between said light source and said opposite end of said housing for imparting optical image data to said projected light beam; projection optics for accumulating the image data emitted by said active matrix LCD panel and projecting an optically enhanced light beam through said other end of said housing onto a projection surface; and control circuit means for applying signals to said active matrix LCD panel to enhance said beam of white light with image data.

2. A reflector spotlight as defined in claim 1, wherein said spotlight luminaire is an ellipsoidal reflector spotlight.

3. A reflector spotlight as defined in claim 1, wherein said light source comprises at least one white light emitting LED.

4. A reflector spotlight as defined in claim 1, wherein said at least one LED is mounted on a PCB and has an optical axis arranged to be coincident with said housing axis.

5. A reflector spotlight as defined in claim 1, wherein said light source comprises a plurality of white light emitting LEDs.

6. A reflector spotlight as defined in claim 3, wherein said luminaire comprises a reflector defining a focal point and said at least one white light LED is arranged substantially at said focal point.

7. A reflector spotlight as defined in claim 6, wherein said light source comprises a plurality of LEDs clustered proximate to said focal point.

8. A reflector spotlight as defined in claim 6, wherein said reflector comprises an ellipsoidal reflector.

9. A reflector spotlight as defined in claim 6, wherein said reflector comprises a parabolic reflector.

10. A reflector spotlight as defined in claim 6, wherein said reflector comprises a spherical reflector.

11. A reflector spotlight as defined in claim 6, wherein said light source comprises an array of white light emitting LEDs mounted on a printed circuit board arranged proximate to said focal point.

12. A reflector spotlight as defined in claim 11, wherein said printed circuit board is arranged in a place generally normal to said housing axis.

13. A reflector spotlight as defined in claim 11, wherein each LED defines an optical axis arranged to produce a beam of white light reflected from said reflector and merge at a focal point remote from said reflector.

14. A reflector spotlight as defined in claim 13, wherein said active matrix LCD panel is arranged in a plane substantially normal to said housing axis and proximate to said remote focal point for intercepting said beam of white light.

15. A reflector spotlight as defined in claim 14, wherein said LCD panel has a surface area substantially corresponding to a cross-sectional area of said beam of white light at the point where said beam impinges on said active matrix LCD panel.

16. A reflector spotlight as defined in claim 15, wherein said active matrix LCD panel has a DPI and active area selected to optimize cost of said panel for a given desired resolution.

17. A reflector spotlight as defined in claim 1, further comprising optical means proximate to said active matrix LCD panel for enhancing optical image data incident on and/or transmitted through said active matrix LCD panel.

18. A reflector spotlight luminaire comprising a housing defining an optical axis; a light source at one axial end of said housing for emitting a beam of white light, said light source being arranged to direct said beam of white light along said axis of said housing and in the direction of an axially opposite end; an LCD panel arranged along said axis between said light source and said opposite end of said housing for imparting optical image data to said projected light beam; projection optics for accumulating the image data emitted by said image engine and projecting an optically enhanced light beam through said other end of said housing onto a projection surface; and means for adjusting the position of said light source along said axis.

19. A reflector spotlight luminaire comprising a housing defining an optical axis; a light source at one axial end of said housing for emitting a beam of white light, said light source being arranged to direct said beam of white light along said axis of said housing and in the direction of an axially opposite end; an image engine arranged along said axis between said light source and said opposite end of said housing for imparting optical image data to said projected light beam; projection optics for accumulating the image data emitted by said image engine and projecting an optically enhanced light beam through said other end of said housing onto a projection surface, said luminaire comprising a reflector defining a focal point and said at least one white light LED being arranged substantially at said focal point;

said light source comprising an array of white light emitting LEDs mounted on a printed circuit board arranged proximate to said focal point;

wherein each LED defines an optical axis arranged to produce a beam of white light reflected from said reflector to merge at a focal point remote from said reflector; and wherein said LCD panel is arranged upstream of said remote focal point.

20. A reflector spotlight luminaire comprising a housing defining an optical axis; a light source at one axial end of said housing for emitting a beam of white light, said light source being arranged to direct said beam of white light along said axis of said housing and in the direction of an axially opposite end; an image engine arranged along said axis between said light source and said opposite end of said housing for imparting optical image data to said projected light beam; projection optics for accumulating the image data emitted by said image engine and projecting an optically enhanced light beam through said other end of said housing onto a projection surface, said luminaire comprising a reflector defining a focal point and said at least one white light LED being arranged substantially at said focal point;

said light source comprising an array of white light emitting LEDs mounted on a printed circuit board arranged proximate to said focal point;

wherein each LED defines an optical axis arranged to produce a beam of white light reflected from said reflector to merge at a focal point remote from said reflector; and wherein said LCD panel is arranged downstream of said remote focal point.

* * * * *